US008395612B2

(12) United States Patent
Liu et al.

(10) Patent No.: US 8,395,612 B2
(45) Date of Patent: Mar. 12, 2013

(54) DISPLAY DRIVING CIRCUIT AND DISPLAY DRIVING CIRCUIT

(75) Inventors: Kang-Yi Liu, Hsin-Chu (TW); Chao-Chieh Chen, Hsin-Chu (TW); Chia-Ming Wu, Hsin-Chu (TW); Chao-Kai Huang, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 279 days.

(21) Appl. No.: 13/027,204

(22) Filed: Feb. 14, 2011

(65) Prior Publication Data

US 2012/0075280 A1 Mar. 29, 2012

(30) Foreign Application Priority Data

Sep. 29, 2010 (TW) ..... 99132995 A

(51) Int. Cl.
*G09G 5/00* (2006.01)

(52) U.S. Cl. ..... 345/212; 345/99; 345/205; 345/211

(58) Field of Classification Search ..... 345/98, 345/99, 100, 205, 211, 212
See application file for complete search history.

(56) References Cited

U.S. PATENT DOCUMENTS

| | | | | |
|---|---|---|---|---|
| 7,688,934 | B2 | 3/2010 | Tsai | |
| 8,018,451 | B2 | 9/2011 | Park | |
| 2003/0001800 | A1* | 1/2003 | Nakajima et al. | 345/55 |
| 2006/0164366 | A1 | 7/2006 | Yu | |
| 2008/0036520 | A1 | 2/2008 | Takahashi | |
| 2008/0309655 | A1* | 12/2008 | Ito | 345/211 |
| 2011/0115771 | A1 | 5/2011 | Cheng | |

FOREIGN PATENT DOCUMENTS

| | | | |
|---|---|---|---|
| CN | 101221730 | A | 7/2008 |
| CN | 101303896 | A | 11/2008 |
| CN | 101534051 | A | 9/2009 |
| CN | 101598859 | A | 12/2009 |
| CN | 101707054 | A | 5/2010 |

* cited by examiner

*Primary Examiner* — Amare Mengistu
*Assistant Examiner* — Premal Patel
(74) *Attorney, Agent, or Firm* — Winston Hsu; Scott Margo

(57) ABSTRACT

A display driving circuit includes a timing controller, agate driving circuit, a control unit, a boost converter and a level shifter. The timing controller functions to provide a first start pulse. The level shifter generates a second start pulse by level shifting the first start pulse. The gate driving circuit includes a plurality of shift registers coupled in series and is driven by the second start pulse and the level shifter so as to generate gate signals. The control unit uses the second start pulse and a gate signal generated by a kth shift register to switch a high working voltage provided to the level shifter by the boost converter to a suitable range for driving the gate driving circuit.

18 Claims, 10 Drawing Sheets

DISPLAY DRIVING CIRCUIT AND DISPLAY DRIVING CIRCUIT

BACKGROUND OF THE INVENTION

1. Field of the Invention

The invention relates to a display driving circuit, and more particularly, to a display driving circuit capable of solving a cold start problem.

2. Description of the Prior Art

Liquid crystal displays (LCDs) have the advantages of slim size, low power consumption and no radiation. The LCD has become one of the most widely used flat panel displays. The principle of the LCD is to apply an electric field to a liquid crystal layer, which changes alignment of liquid crystal molecules to adjust light transmittance. The LCD further requires a light source provided by a backlight module and a color filter to produce color images. FIG. 1 is a schematic diagram of a conventional LCD 100. With reference to FIG. 1, the LCD 100 comprises a display panel 110, a timing controller 120, a gate driver 130 and a source driver 140. The display panel 110 comprises a plurality of pixels units 150, a plurality of data lines $D_1$~$D_M$ and a plurality of gate lines $G_1$~$G_N$. The timing controller 120 provides control signals for driving the gate driver 130 and the source driver 140. The gate driver 130 produces a plurality of gate signals according to the control signals. The gate lines $G_1$~$G_N$ and data lines $D_1$~$D_M$ provide the gate signals and the data signals which are generated by the gate driver 130 and the source driver 140 to the pixel units 150 to produce an image, respectively.

In order to reduce manufacturing costs, the gate driver 130 can be integrated into the display panel 110 with the pixel units 150 to replace conventional gate driver ICs, saving on IC use and reducing the number of signal traces. Both such techniques and conventional gate driver ICs require shift registers and level shifters. The level shifter functions to raise original control signals to a higher voltage level for driving the gate driver. In practice, such technique applies a thin-film transistor (TFT) n-type metal-oxide-semiconductor (NMOS) process to construct shift registers, and the level shifters are integrated in pulse width modulation (PWM) ICs, which is different from conventional gate driver ICs that apply a complementary metal-oxide-semiconductor (CMOS) process to integrate shift registers and level shifters into a single chip. However, due to the process and the number of masks, TFT NMOS circuit characteristics are not as good as CMOS circuit characteristics. Thus, it is necessary to set a higher gate-source voltage ($V_{GS}$) for TFT NMOS devices, and fabricate devices with larger size to obtain the same current. $V_{GS}$(off) of the transistors must also be low.

Furthermore, the device characteristics may drift due to process variation. This causes the shift registers to malfunction during a cold start. FIG. 2 is a circuit diagram of a shift register 200 according to the prior art. FIG. 3A illustrates a timing diagram of the shift register 200 under normal operation. When started at room temperature, start pulse signal ST sends out a pulse to raise a node CP1 to a voltage level similar to ST. When the clock signal CLK is sent out, the original potential kept in Cgd of transistor M2 raises the voltage level of node CP1 via coupling. At this time, the transistor M2 is turned on and transmits the CLK signal to output terminal SR_OUT. Output of the gate signal at the first stage is completed. However, when started at a low temperature, because of the drop in current provided by M2 (i.e. conduction of devices is weak) and the leakage current of M4, the voltage level of SR_OUT can not be raised if the size and the $V_{GS}$ of the devices are fixed, leading to abnormal signal output, as shown in FIG. 3B.

FIG. 4 illustrates a circuit that generates control signals for driving the gate driver 140. When started at room temperature, all of the gate signals can be generated normally by two-stage charge pump circuit 410 (not including charge pump 430). But, when started at low temperature, as described above, the transistors are unable to be fully turned on if the size and the $V_{GS}$ of the devices are fixed. As a result, the gate signals are outputted abnormally. Currently, this problem is solved by adding one more charge pump stage 430 to raise the high working voltage $V_{GH}$ of the gate driver 130, that is, to enhance turning-on of the transistors and to improve the driving ability of the current. The circuit utilizing the conventional solution to address the cold start problem has the following disadvantages:

1. Printed circuit board (PCB) area increases due to adding the extra charge pump circuit stage 430.
2. Power consumption increases due to the extra charge pump circuit stage 430.
3. Output voltage of the charge pump is fixed, and cannot be adjusted flexibly. The device characteristics also vary, necessitating the addition of Zener diodes to meet power source specifications required by the gate driver 130. The voltage setting is inflexible and costs increase.

SUMMARY OF THE INVENTION

Accordingly, the present invention is directed to a circuit and a method of driving a LCD with low power consumption, flexible design and that substantially obviate one or more problems due to limitations and disadvantages of the related art.

The present invention discloses a display driving circuit. The display driving circuit comprises a timing controller, a gate driver, a control unit, a boost converter and a level shifter. The timing controller is employed to provide a first start pulse signal. The gate driver comprises a plurality of shift registers coupled in series. The plurality of shift registers sequentially generates gate signals according to a preliminary driving signal and a second start pulse signal. The control unit, electrically connected to the kth shift register of the gate driver, is utilized for generating an output voltage according to the second start pulse signal and the gate signal generated by the kth shift register. The boost converter, electrically connected to the control unit, is utilized for generating a working voltage according to the output voltage of the control unit. The level shifter, electrically connected to the timing controller, the gate driver and the boost converter, is employed to generate the second start pulse signal and the preliminary driving signal for driving the gate driver according to said working voltage and said first start pulse signal.

The present invention further discloses a liquid crystal display. The liquid crystal display comprises a first substrate, a second substrate, a liquid crystal layer, a pixel array and a display driving circuit. The liquid crystal layer is disposed between the first substrate and the second substrate. The pixel array is formed on the first substrate. The display driving circuit comprises a timing controller, a gate driver, a control unit, a boost converter and a level shifter. The timing controller is employed to provide a first start pulse signal. The gate driver is formed on the first substrate and electrically connected to the pixel array. The gate driver comprises a plurality of shift registers connected in series; wherein the plurality of shift registers sequentially generate gate signals according to a preliminary driving signal. The control unit, electrically connected to the kth shift register of the gate driver, is utilized for generating an output voltage according to the second start pulse signal and the gate signal generated by the kth shift register. The boost converter, electrically connected to the control unit, is utilized for generating a working voltage according to the output voltage. The level shifter, electrically connected to the timing controller, the gate driver and the boost converter, is employed to generate the second start pulse signal and the preliminary driving signal for driving the gate driver according to said working voltage and said first start pulse signal.

These and other objectives of the present invention will no doubt become obvious to those of ordinary skill in the art after reading the following detailed description of the preferred embodiment that is illustrated in the various figures and drawings.

DETAILED DESCRIPTION

This invention proposes a display driving circuit that solves the cold start problem, which may be caused at low room temperature when the gate driver is integrated into the display panel. The display driving circuit makes each shift register of the gate driver output gate signals normally to drive the pixel array on the display panel for low power consumption.

Figure 1:
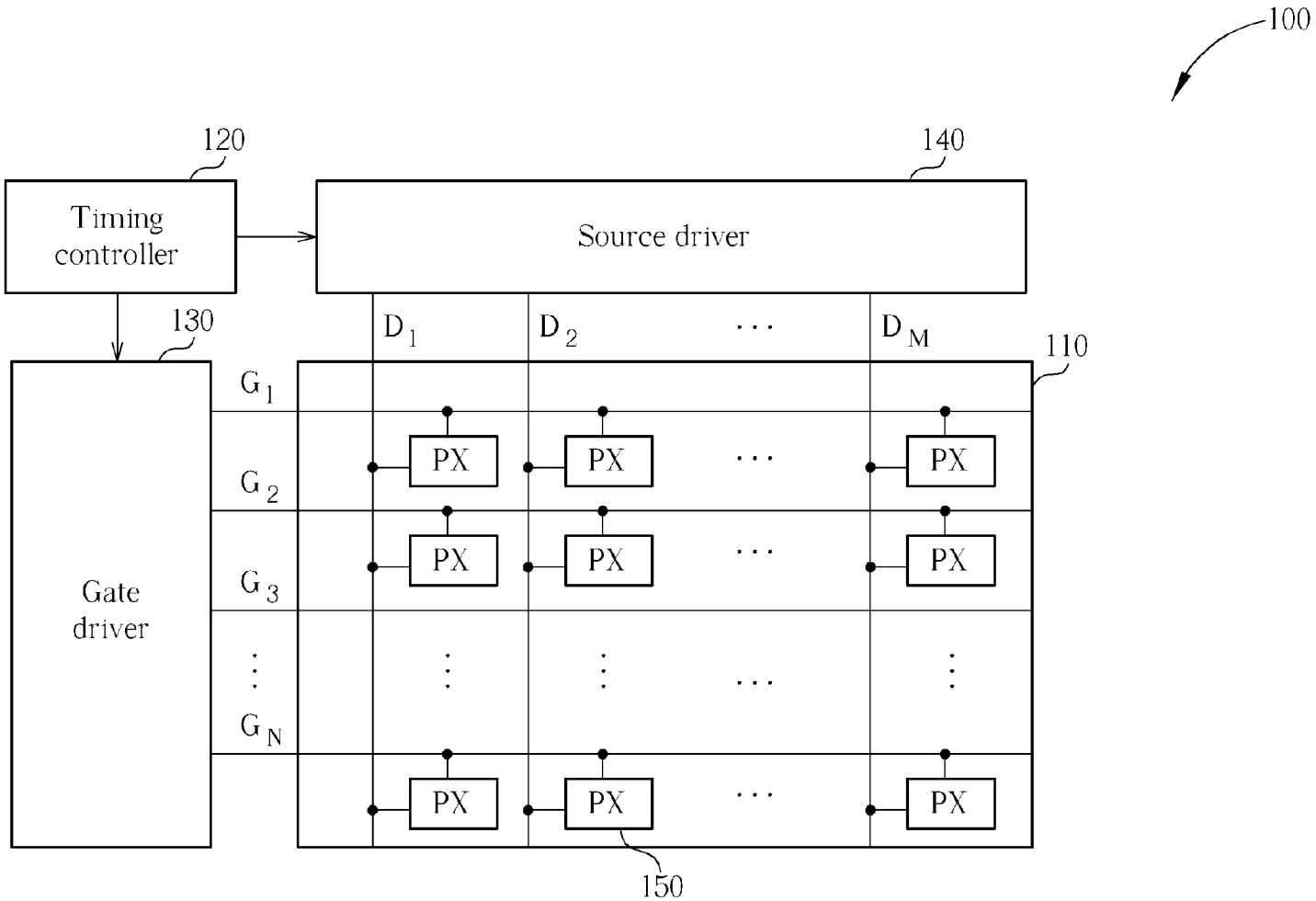
FIG. 1 PRIOR ART
FIG. 1 is a schematic diagram of a liquid crystal display in the prior art.
Figure 2:
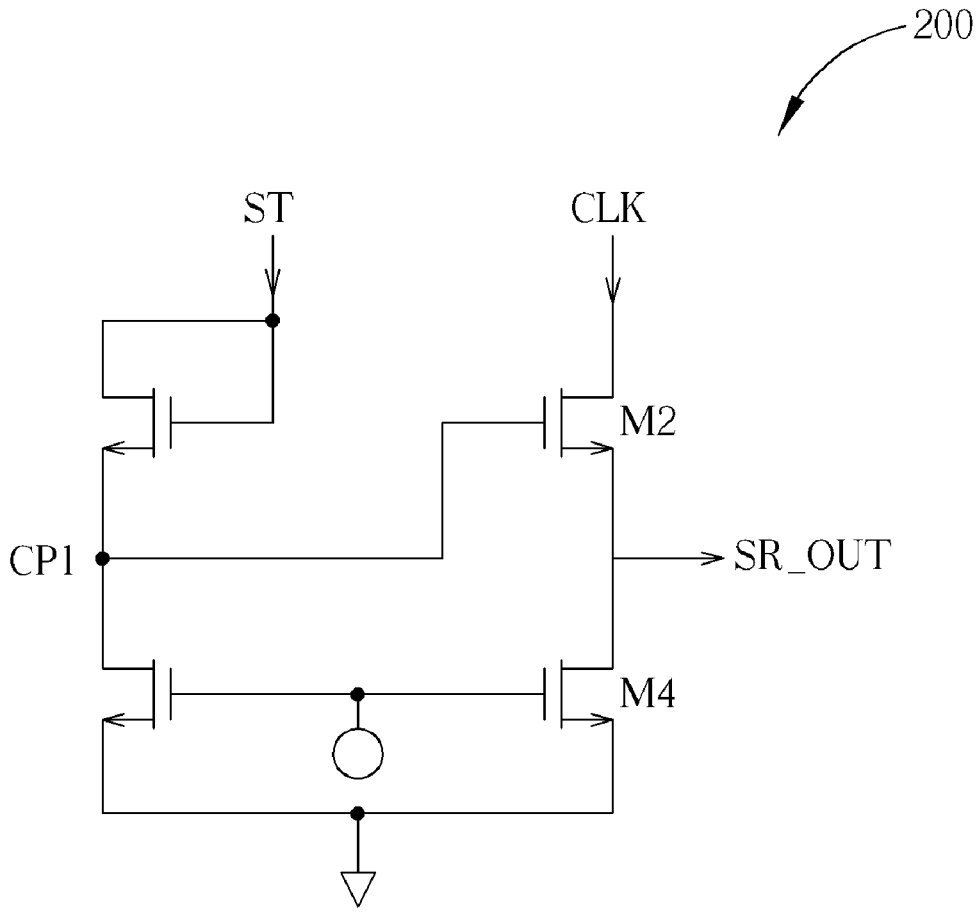
FIG. 2 PRIOR ART
FIG. 2 is a circuit diagram of a shift register in the prior art.
Figure 3A:
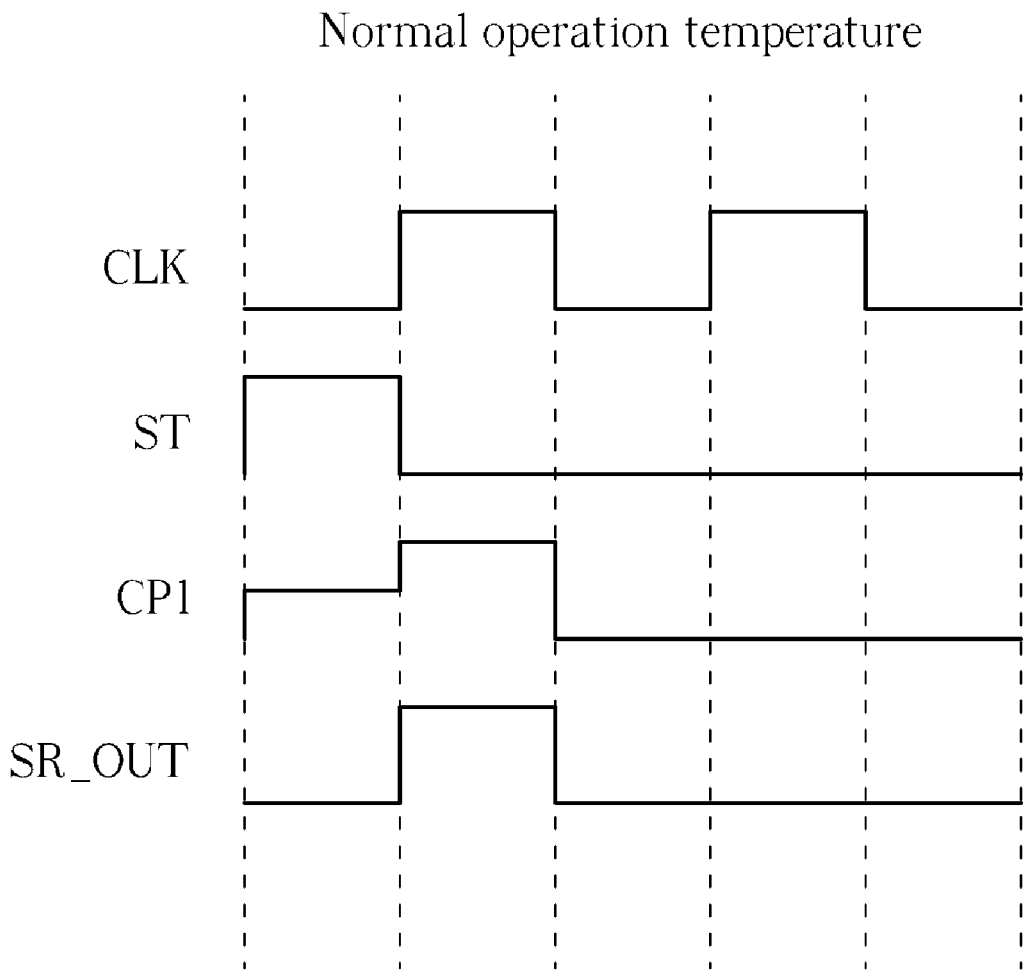
FIG. 3A PRIOR ART
FIG. 3A is a timing diagram illustrating normal operation of the shift register shown in FIG. 2.
Figure 3B:
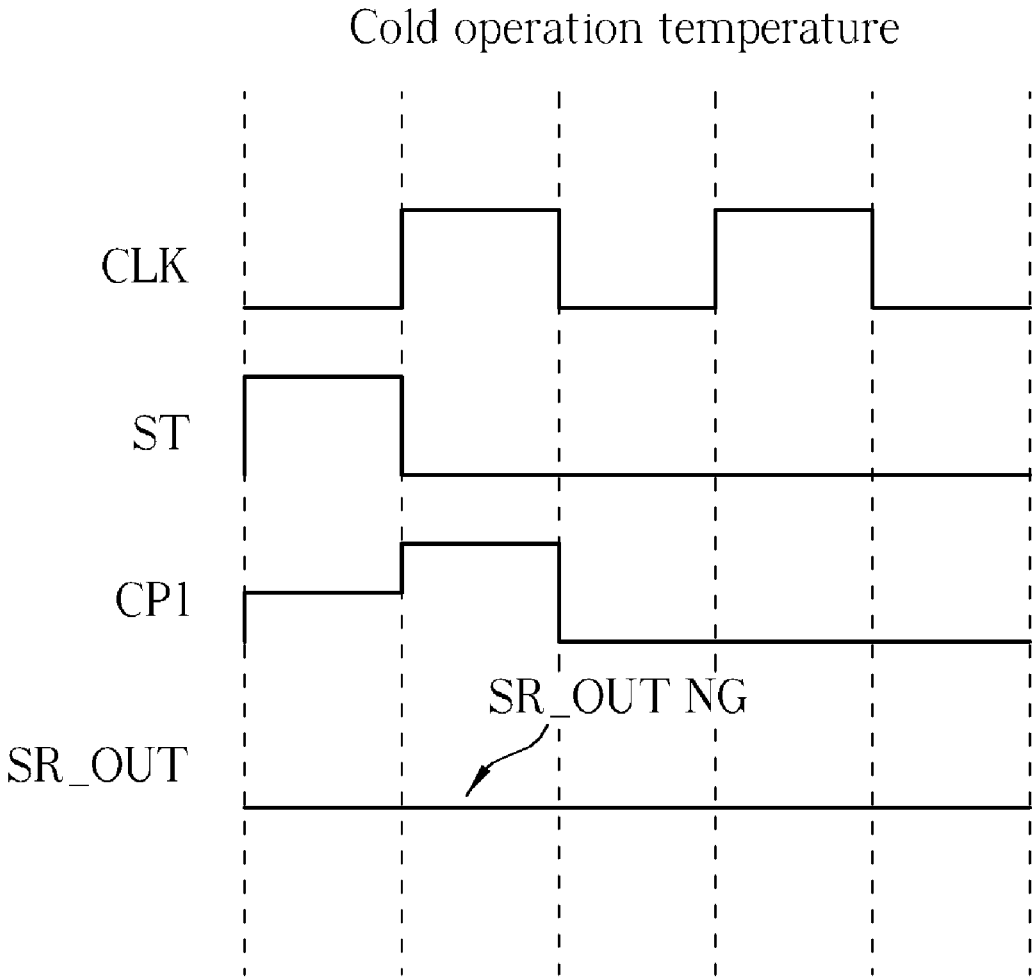
FIG. 3B PRIOR ART
FIG. 3B is a timing diagram illustrating abnormal operation of the shift register shown in FIG. 2 when a cold start problem occurs.
Figure 4:
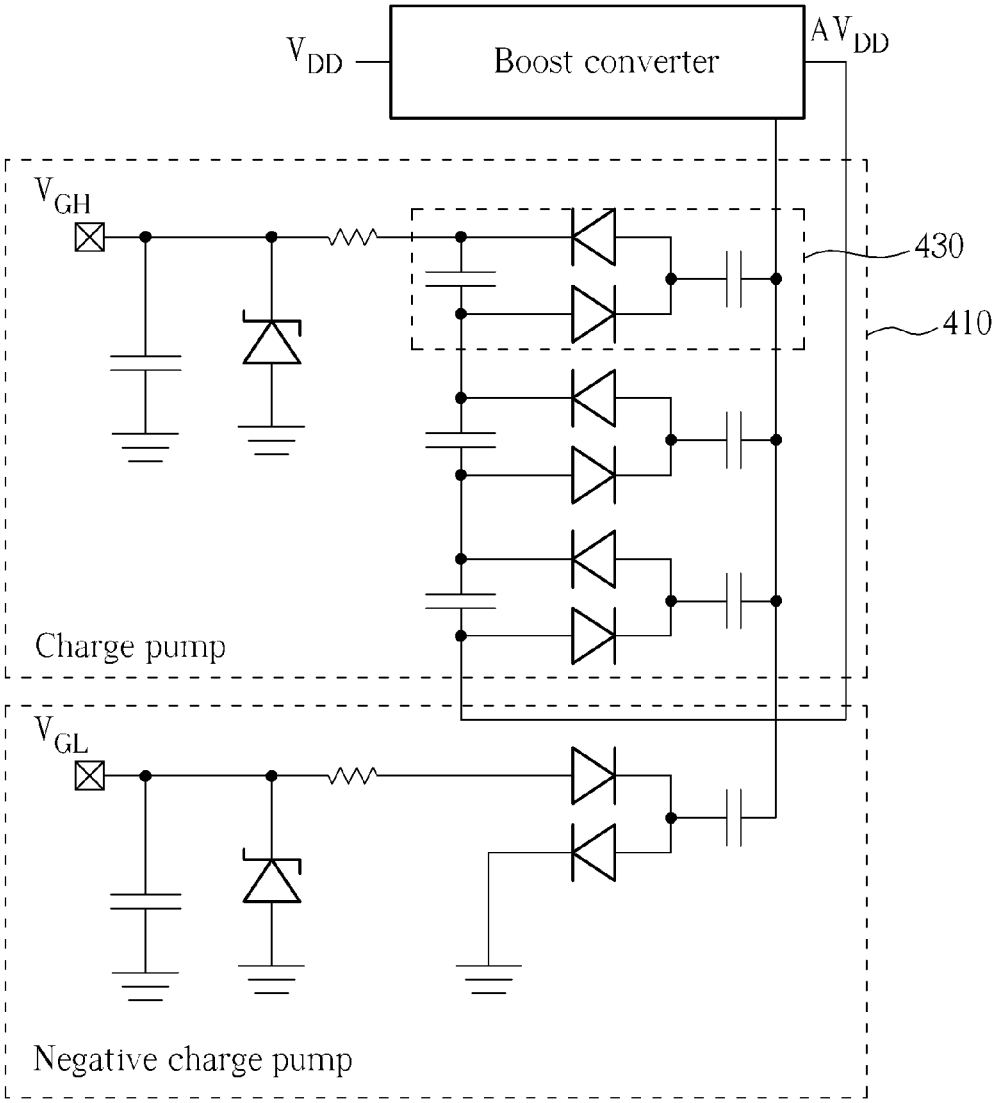
FIG. 4 PRIOR ART
FIG. 4 is circuit diagram of a circuit for driving a gate driver in the prior art.
Figure 5:
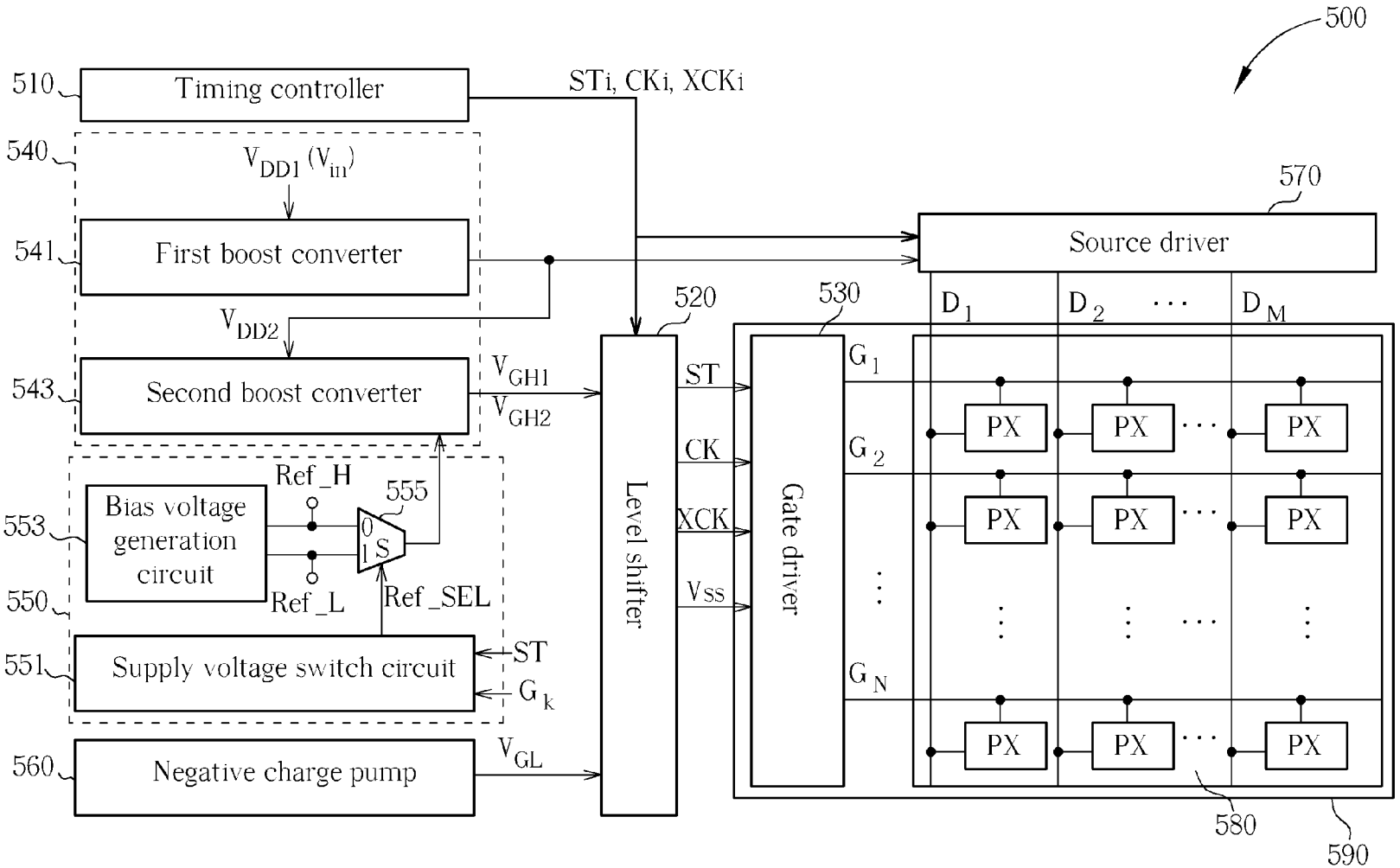
FIG. 5 is a schematic diagram of a liquid crystal display and its driving circuits according to an embodiment of the invention.

FIG. 5 illustrates a block diagram of a liquid crystal display 500 according to an embodiment of the present invention. As shown in FIG. 5, the LCD 500 includes an upper substrate (not shown), a lower substrate 590, a display driving circuit and a pixel array 580. The display driving circuit includes a timing controller 510, a level shifter 520, a gate driver 530, a boost converter 540, a control unit 550, a negative charge pump 560 and a source driver 570. A liquid crystal layer is disposed between the upper substrate and the lower substrate. The liquid crystal layer is filled with liquid crystal molecules. The pixel array 580 includes a plurality of pixel units PX and is electrically connected to the source driver 570 and gate driver 530 via data lines D1~DM and gate lines G1~GN, respectively. The gate driver 530 can be integrated into the lower substrate 590.

The timing controller 510 controls time sequential operations of the LCD 500. For each frame period, the timing controller 510 sets a scanning start and provides a start pulse signal STi to drive the gate driver 530 and make the gate driver 530 generate gate signals for setting the switches of the pixel units PX. Besides, the timing controller 510 also provides control signals for the source driver 570 to generate image data. The boost converter 540 boosts the voltage VDD1 to obtain a higher voltage. In this embodiment, two boost converters 541, 543 are connected in series, wherein a voltage VDD2 which is generated by the first boost converter 541 is supplied to the source driver 570 or other driving circuits such as a gamma correlation circuit. The voltage VDD2 is inputted to the second boost converter 543 for being boosted again.

The boost converter 540 adopts an on-off switching structure, uses inductances and capacitors, and adjusts a resistor to achieve a suitable output voltage level. The on-off switching structure uses changes in on-off duty to adjust an input/output ratio, that is, it charges/discharges the inductances and capacitors by an on-off switch. Thus, current does not always flow into the load. Voltage boosting is achieved by using on-off switching to charge/discharge the inductances and capacitors. In the prior art, using a charge pump circuit to achieve the same voltage level, it is necessary to connect one more charge pump stage (two diodes). Each diode has equivalent forward resistance and forward turn-on voltage, which causes more power consumption when connecting one more charge pump stage, and voltage stabilization is not provided. Therefore, the efficiency of a boost converter is better than the efficiency of a charge pump for the same voltage level. PCB area can also be saved.

The level shifter 520 is electrically connected to the timing controller 510 and the boost converter 540. It generates preliminary driving signals (such as Vss, CK, XCK in FIG. 5) and a level-shifted start pulse signal ST for driving the gate driver 530 according to the start pulse signal STi generated by the timing controller 510 and the high working voltage VGH provided by the boost converter 540. The negative charge pump circuit 560 is electrically connected to the level shifter 520 and provides a low working voltage VGL to the level shifter 520.

Figure 6:
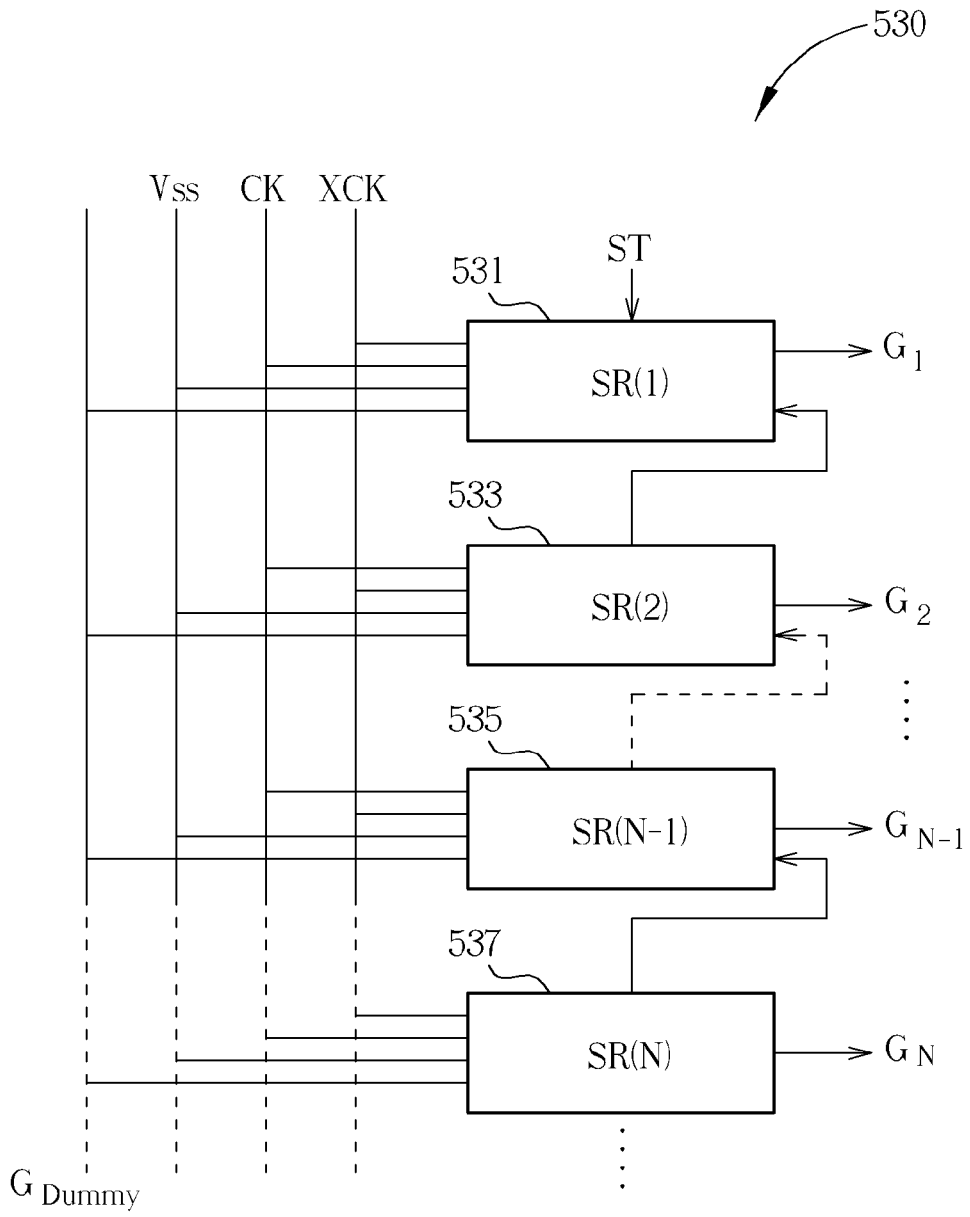
FIG. 6 is a circuit diagram of a gate driver according to an embodiment of the present invention.

The block diagram of the gate driver 530 is shown in FIG. 6. The gate driver 530 comprises a plurality of shift registers 531~537 connected in series. Each shift register 531~537 outputs agate signal G1~GN. The first shift register 531 receives the start pulse signal ST and the gate signal G2, which is generated by the next stage of shift register, to generate gate signal G1, and the other shift register 533~537 are driven by the gate signal of the next shift register 535~537. For example, the (N−1)th shift register receives the gate signal outputted by the Nth shift register. The shift registers sequentially generate gate signals G1~GN to input to the pixel array 580 through a plurality of gate lines for displaying images. Each shift register further receives a preliminary driving signal which comprises a first clock signal CK, a second clock signal XCK, and voltage source VSS, etc. The voltage source VSS is the voltage reference for the gate signals G1~GN. In this embodiment, serial connection of the shift registers 531~537 and respective driving voltages Vss, CK, XCK required thereby are not intended to limit the invention. The shift registers 531~537 may be connected in other ways as well.

Returning to FIG. 5, the control unit 550 is electrically connected to the gate driver 530, and receives the start pulse signal ST and the gate signal Gk generated by the kth shift register to dynamically switch the high working voltage VGH provided by the boost converter 540 to a suitable range for driving the gate driver 530. When the cold start problem occurs, the boost converter 540 automatically switches VGH to a higher working voltage VGH1. When the gate driver returns to normal operation, the boost converter 540 also switches VGH to a lower working voltage VGH2 to reduce the power consumption of the system. In this embodiment, each shift register is driven by the gate signal outputted by the next shift register. When any stage of the shift registers cannot output gate signals normally due to the cold start problem, all following shift registers will fail. Therefore, in the preferred embodiment, the control unit 550 is set to receive the gate signal GN of the last stage shift register 537 to detect whether there is a cold start problem among the shift registers 531~537.

As shown FIG. 5, the control unit 550 includes a supply voltage switch circuit 551 for receiving the start pulse signal ST and the gate signal Gk of the kth stage shift register (such as the gate signal $G_N$ of the last stage shift register) to generate a voltage selecting signal Ref_SEL, a bias voltage generation circuit 553 for generating a plurality of stable reference voltages Ref_H, Ref_L with different voltages, and a multiplexer 555 electrically connected to the supply voltage switch circuit 551 and the bias voltage generation circuit 553, for selecting an output from the plurality of reference voltages Ref_H, Ref_L according to the voltage selecting signal Ref_SEL. The output terminal of the multiplexer 555 is electrically connected to the second boost converter 543, and the voltage level of the high working voltage VGH outputted by the second boost converter 543 is adjusted by selecting different reference voltages.

Figure 7:
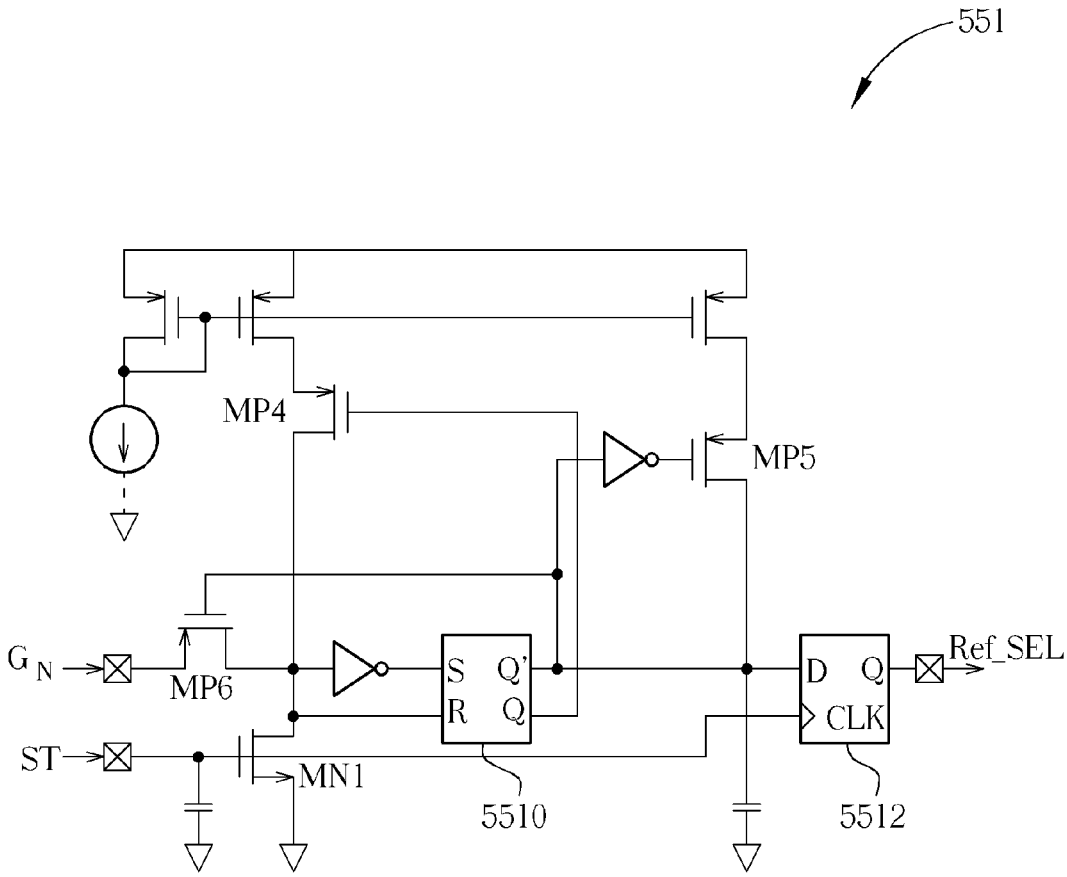
FIG. 7 is a circuit diagram of a supply voltage switch circuit according to an embodiment of the present invention.
Figure 8A:
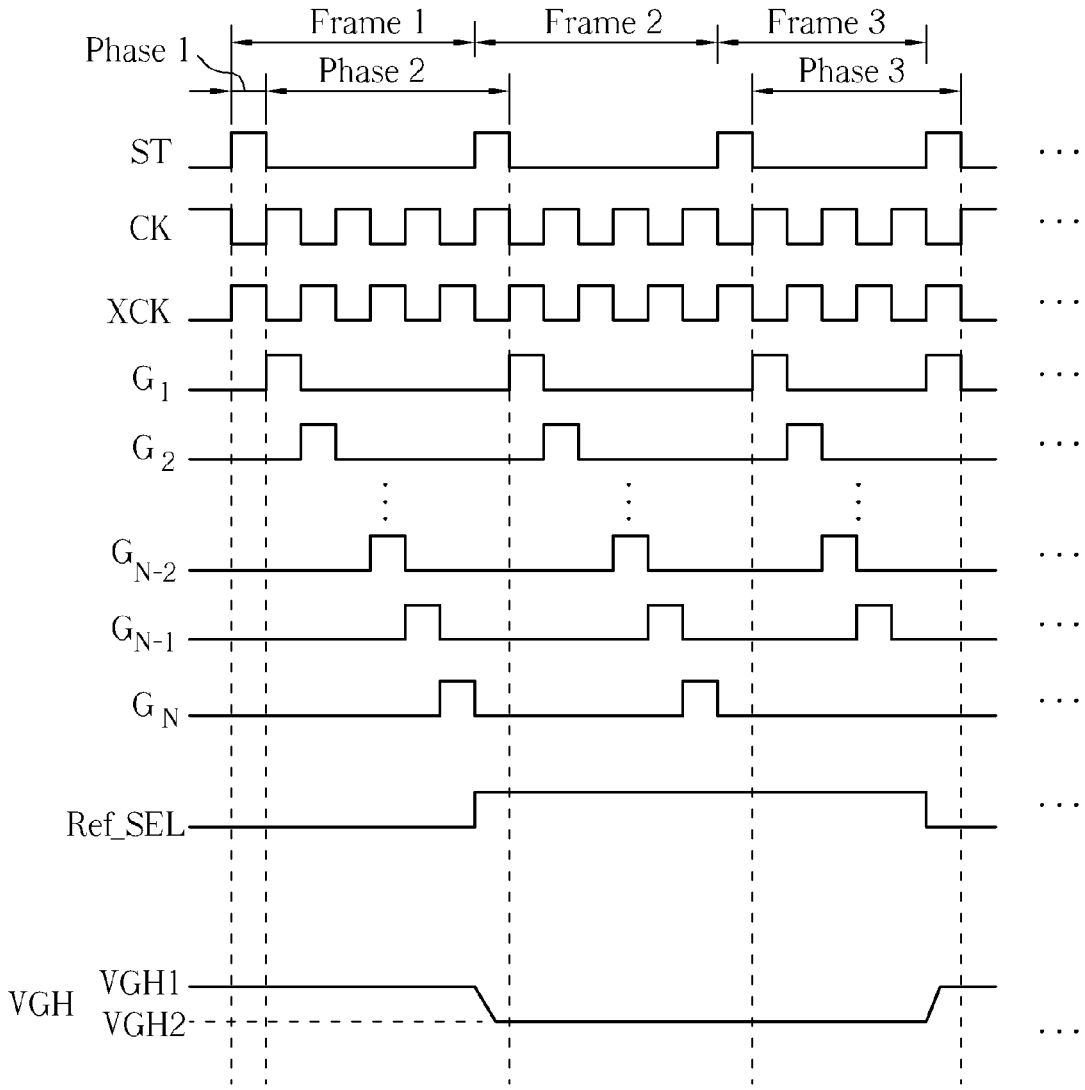
FIG. 8A is a timing diagram illustrating a plurality of signals of the driving circuit according to an embodiment of the present invention.
Figure 8B:
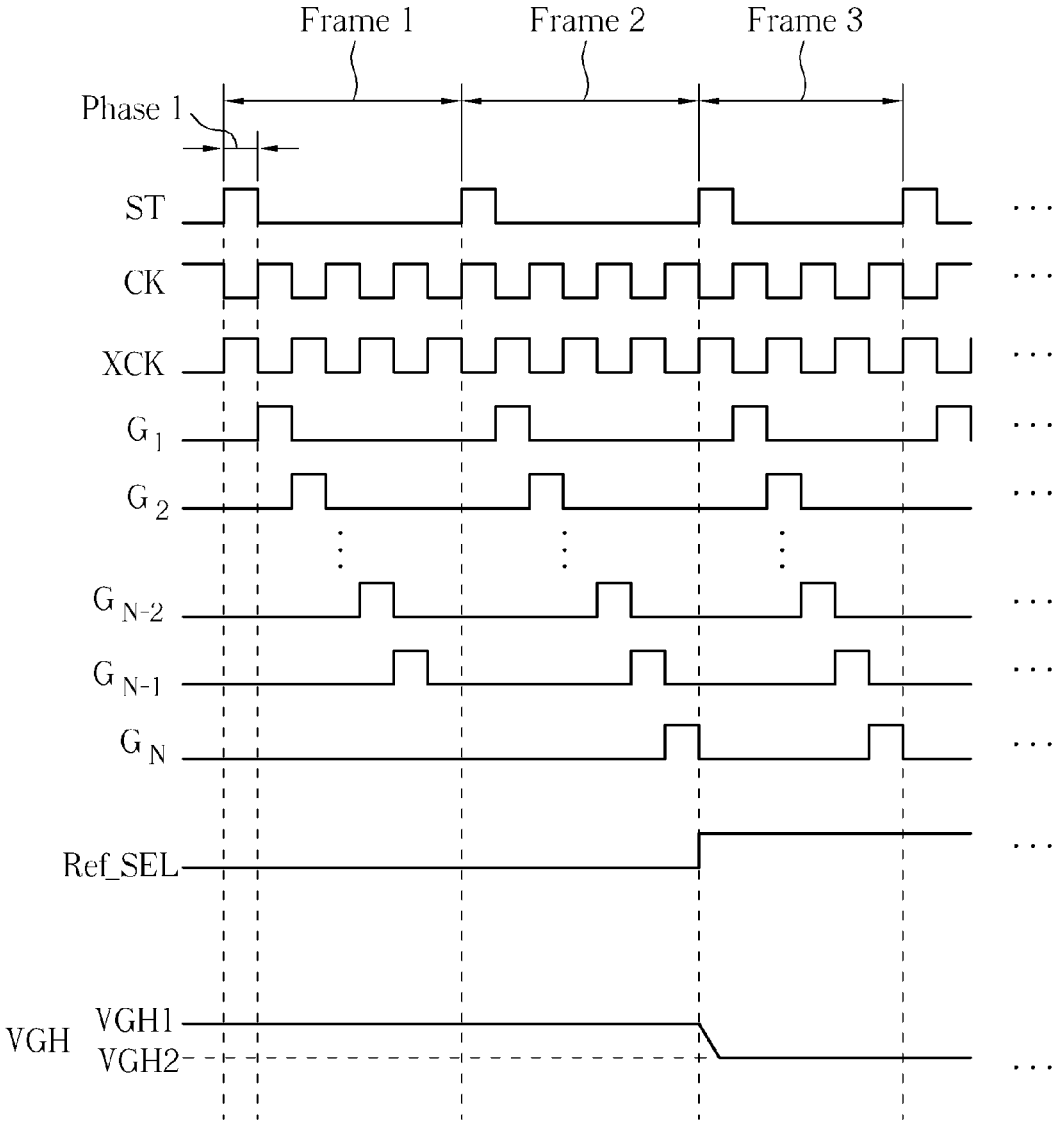
FIG. 8B is another timing diagram illustrating a plurality of signals of the driving circuit according to an embodiment of the present invention.

FIG. 7 is a circuit diagram of the supply voltage switch circuit 551. The operation and the time sequence of the supply voltage switch circuit 551 is illustrated in FIG. 8A and FIG. 8B. The circuit includes three working phases, of which phase 1 is circuit reset and initialization. During phase 1, latch 5510 and related nodes are reset and initialized as shown in FIG. 8A. The start pulse ST is sent out at the beginning of each frame. At this time, the gate signal GN of the final stage of shift register 537 has not been outputted, thus the start pulse ST is at high logical level and the gate signal GN is at low logical level. The high logical level start pulse ST turns on the NMOS MN1 and pulls the reset terminal R of the SR latch 5510 to a low logical level. The set terminal S of the SR latch 5510 rises to the high logical level because of the inverter, therefore the output terminal Q is at the high logical level and the output terminal Q' is at the low logical level. PMOS transistors MP4, MP5, MP6 are turned off by the above logical states. The output terminal Q' is connected to the data terminal D of the D flip-flop 5512. Simultaneously, the input pulse of ST triggers the D flip-flop 5512 to output the signal at the low logical level, that is, to output the voltage selecting signal Ref_SEL at the low logical level.

Next, during phase 2, when the gate driver has been reset, initialized, and operates normally without the cold start problem, MN1 remains off and prepares for the inputting of GN. When the pulse of GN is generated, PMOS transistor MP6 is turned on and sets the R terminal of the SR latch 5510 to the high logical level, and the S terminal to the low logical level. The output terminal Q of the SR latch 5510 is at the low logical level, and the bar output terminal Q' is at the high logical level, which causes the PMOS transistors MP4 and MP5 to turn on. When GN is switched from high logical level to low logical level, the pulse of ST is inputted to the clock terminal CLK of the D flip-flop 5512 simultaneously, thus the voltage selecting signal Ref_SEL changes from the low logical level to the high logical level. The Ref_SEL at the high logical level causes the multiplexer 555 to select a lower reference voltage REF_L to output to the second boost converter 543, so that the high working voltage VGH switches from VGH1 to VGH2 and stays at VGH2.

The start pulse ST functions to reset and initialize the circuit, as well as to update the level of the voltage selecting signal Ref_SEL. At the beginning of frame 3, GN has changed from high logical level to low logical level, hence the PMOS transistor MP6 turns off. If the cold start problem occurs in the gate driver 530 and GN cannot output normally during frame 3, the PMOS transistor MP6 will remain turned off. At this time, the start pulse ST rises from low logical level to high logical level again. The PMOS transistor MP5 turns off because the bar output terminal Q' of the SR latch 5510 is at low logical level. When the start pulse ST triggers the clock signal of the D flip-flop 5512, the voltage selecting signal Ref_SEL at the output terminal Q of the D flip-flop 5512 changes to the low logical level. Accordingly, the multiplexer 555 selects the high reference voltage REF_H as an input to the second boost converter 543 so that the high working voltage VGH switches from VGH2 to VGH1.

FIG. 8B illustrates a timing sequence of the gate driver 530 with the cold start problem from the start. After circuit reset and initialization in phase 1, the pulse of GN is not generated normally during frame 1. The operation of the supply voltage switch circuit 551 is described as in FIG. 8A, the voltage selecting signal Ref_SEL of the D flip-flop 5512 changes or stays at the low logical level, causing the multiplexer 555 to continue outputting the high reference voltage REF_H to the second boost converter 543, and the high working voltage VGH to stay at the higher voltage VGH1, similar to the behavior during phase 3 described in FIG. 8A. The higher working voltage VGH1 is applied to drive the gate driver 530 and returns the gate driver 530 to normal operation, so as to generate GN correctly. The GN at the high state makes the bar output terminal Q' of the SR latch 5510 transition high. Subsequently, the pulse of ST in frame 3 triggers the clock terminal CLK of the D flip-flop 5512, and thereby causes the voltage selecting signal Ref_SEL to switch to the high logical level, and the high working voltage VGH to switch to the lower voltage VGH2, similar to the behavior during phase 2 described in FIG. 8A.

As described above, according to the embodiments of the present invention, the boost converter with higher conversion efficiency is substituted for the charge pump with lower conversion efficiency, thereby reducing the power consumption of the circuit. Furthermore, by performing feedback detection and dynamic gate working voltage switching at the beginning of each frame, it is possible to detect whether a cold start problem occurs during a previous frame that would cause the gate signal to not be generated normally. The gate driver is restored to normal operation by switching to the higher gate working voltage. In addition, it is possible to generate suitable working voltages VGH1, VGH2 according to the characteristics of transistors flexibly.

While the present invention has been described with respect to preferred embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

Those skilled in the art will readily observe that numerous modifications and alterations of the device and method may be made while retaining the teachings of the invention.

What is claimed is:

1. A display driving circuit comprising:

a timing controller for generating a first start pulse signal;

a gate driver, comprising a plurality of shift registers coupled in series, wherein the plurality of shift registers sequentially generate gate signals according to a preliminary driving signal and a second start pulse signal;

a control unit, electrically connected to the kth shift register of the gate driver, for generating an output voltage according to the second start pulse signal and the gate signal generated by the kth shift register;

a boost converter, electrically connected to the control unit, for generating a working voltage according to the output voltage of the control unit; and a level shifter, electrically connected to the timing controller, the gate driver and the boost converter, for generating the second start pulse signal and the preliminary driving signal for driving the gate driver according to said working voltage and said first start pulse signal.

2. The display driving circuit as claimed in claim 1, wherein the control unit comprises:

a reference voltage generator, for generating a plurality of reference voltages with different voltages;

a supply voltage switch circuit, electrically connected to the level shifter and the kth shift register, for generating a voltage selecting signal according to the second start pulse signal and the gate signal generated by the kth shift register; and a multiplexer, electrically connected to the supply voltage switch circuit and the reference voltage generator, for outputting one of said reference voltages as the output voltage.

3. The display driving circuit as claimed in claim 2, wherein the supply voltage switch circuit comprises:

a latch circuit, electrically connected to the level shifter and the kth shift register, for generating a voltage signal according to the second start pulse signal and the gate signal generated by the kth shift register; and an output circuit, electrically connected to the level shifter, the latch circuit and the multiplexer, for generating the voltage selecting signal according to the second start pulse signal and the voltage signal.

4. The display driving circuit as claimed in claim 1, wherein the kth shift register is the last shift register of the gate driver.

5. The display driving circuit as claimed in claim 1, wherein said boost converter comprises:

a first boost converter, for boosting a power source signal to generate a boosted voltage signal; and a second boost converter, electrically connected to the first boost converter and the control unit, for generating the working voltage according to the output voltage and the boosted voltage signal.

6. The display driving circuit as claimed in claim 1, further comprising a charge pump, electrically connected to the level shifter, for inputting a low working voltage to the level shifter.

7. A display driving method, comprising:

providing a display driving circuit comprising:

a timing controller for generating a first start pulse signal;

a gate driver, comprising a plurality of shift registers coupled in series, wherein the plurality of shift registers sequentially generate gate signals according to a preliminary driving signal and a second start pulse signal;

a control unit, electrically connected to the kth shift register of the gate driver, for generating an output voltage according to the second start pulse signal and the gate signal generated by the kth shift register;

a boost converter, electrically connected to the control unit, for generating a working voltage according to the output voltage of the control unit; and a level shifter, electrically connected to the timing controller, the gate driver and the boost converter, for generating the second start pulse signal and the preliminary driving signal for driving the gate driver according to said working voltage and said first start pulse signal;

inputting a start pulse signal and the preliminary driving signal to the gate driver to make the plurality of shift registers of the gate driver sequentially generate gate signals;

inputting the start pulse signal and the gate signal generated by the kth shift register to the control unit;

generating the output voltage to the boost converter according to the start pulse and the gate signal generated by the kth shift register;

generating the working voltage to the level shifter according to the output voltage; and generating the preliminary driving signal for driving the gate driver according to the working voltage.

8. The display driving method according to claim 7, wherein the step of generating the output voltage to the boost converter according to the start pulse and the gate signal generated by the kth shift register comprises:

generating a plurality of reference voltages with different voltages;

generating a voltage selecting signal according to the start pulse signal and the gate signal generated by the kth shift register; and outputting one of the reference voltages as the output voltage to the boost converter according to the voltage selecting signal.

9. The display driving method according to claim 8, wherein the step of generating the voltage selecting signal according to the start pulse signal and the gate signal generated by the kth shift register comprises:

generating a voltage signal according to the start pulse signal and the gate signal generated by the kth shift register; and outputting the voltage selecting signal according to the start pulse signal and the voltage signal.

10. The display driving method according to claim 8, wherein the kth shift register is the last shift register of the gate driver.

11. The display driving method according to claim 7, wherein the step of generating the working voltage to the level shifter according to the output voltage comprises:

providing a power source signal;

generating a boosted voltage signal according to the power source signal; and generating the working voltage to the level shifter according to the output voltage and the boosted voltage signal.

12. The display driving method according to claim 7, further comprising:

inputting a low working voltage to the level shifter.

13. A liquid crystal display, comprising:

a first substrate;

a second substrate;

a liquid crystal layer, disposed between the first substrate and the second substrate;

a pixel array, formed on the first substrate; and a display driving circuit, comprising:

a timing controller for providing a first start pulse signal;

a gate driver, formed on the first substrate and electrically connected to said pixel array, comprising a plurality of shift registers connected in series, wherein the plurality of shift registers sequentially generate gate signals according to a preliminary driving signal;

a control unit, electrically connected to the kth shift register of the gate driver, for generating an output voltage according to a second start pulse signal and the gate signal generated by the kth shift register;

a boost converter, electrically connected to the control unit, for generating a working voltage according to the output voltage of the control unit; and a level shifter, electrically connected to the timing controller, the gate driver and the boost converter, for generating the second start pulse signal and the preliminary driving signal for driving the gate driver according to the working voltage and the first start pulse signal.

14. The liquid crystal display as claimed in claim 13, wherein the control unit comprises:

a reference voltage generator, for generating a plurality of reference voltages with different voltages;

a supply voltage switch circuit, electrically connected to the level shifter and the kth shift register, for generating a voltage selecting signal according to the second start pulse signal and the gate signal which is generated by the kth shift register; and a multiplexer, electrically connected to the supply voltage switch circuit and the reference voltage generator, for outputting one of said reference voltages as the output voltage.

15. The liquid crystal display as claimed in claim 14, wherein the supply voltage switch circuit comprises:

a latch circuit, electrically connected to the level shifter and the kth shift register, for generating a voltage signal according to the second start pulse signal and the gate signal generated by the kth shift register; and an output circuit, electrically connected to the level shifter, the latch circuit and the multiplexer, for generating the voltage selecting signal according to the second start pulse signal and the voltage signal.

16. The liquid crystal display as claimed in claim 13, wherein the kth shift register is the last shift register of the gate driver.

17. The liquid crystal display as claimed in claim 13, wherein the boost converter comprises:

a first boost converter, for boosting a power source signal to generate a boosted voltage signal; and a second boost converter, electrically connected to the first boost converter and the control unit, for generating the working voltage according to the output voltage and the boosted voltage signal.

18. The liquid crystal display as claimed in claim 13, further comprising a charge pump, electrically connected to the level shifter, for inputting a low working voltage to the level shifter.

* * * * *